US011629849B2

(12) United States Patent
Xue et al.

(10) Patent No.: US 11,629,849 B2
(45) Date of Patent: Apr. 18, 2023

(54) EXTERNAL CONNECTED LAMP HOLDER, AN INTERCONNECTED LAMP HOLDER, A DRIVING CIRCUIT BOARD AND A LAMP

(71) Applicants: Self Electronics Co., Ltd., Zhejiang (CN); Wanjiong Lin, Zhejiang (CN); Self Electronics USA Corporation, Norcross, GA (US)

(72) Inventors: Yuanfang Xue, Zhejiang (CN); Zhaoyong Zheng, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 17/443,637

(22) Filed: Jul. 27, 2021

(65) Prior Publication Data

US 2022/0034487 A1 Feb. 3, 2022

(30) Foreign Application Priority Data

Jul. 28, 2020 (CN) ..... 202010734752.6

(51) Int. Cl.

| | |
|---|---|
| ***H01R 12/72*** | (2011.01) |
| ***F21V 19/00*** | (2006.01) |
| ***F21V 23/00*** | (2015.01) |
| ***H01R 33/06*** | (2006.01) |

(52) U.S. Cl.

CPC ..... *F21V 19/003* (2013.01); *F21V 23/004* (2013.01); *H01R 12/721* (2013.01); *H01R 33/06* (2013.01)

(58) Field of Classification Search

CPC ..... F21S 4/28; H01R 12/721; H01R 13/113; H01R 33/06; H01R 33/08; F21V 19/003; F21V 19/0065; F21V 21/002; F21V 23/004; F21V 23/06; F21Y 2103/10; F21Y 2115/10

See application file for complete search history.

(56) References Cited

U.S. PATENT DOCUMENTS

| | | | | |
|---|---|---|---|---|
| 6,624,554 | B2 * | 9/2003 | Holzer | F21V 15/01 439/236 |
| 8,021,192 | B2 * | 9/2011 | Takata | F21K 9/272 439/628 |
| 2008/0102711 | A1 * | 5/2008 | Yang | H01R 33/02 439/660 |
| 2010/0201239 | A1 * | 8/2010 | Mostoller | F21V 23/06 313/1 |

(Continued)

*Primary Examiner* — Zheng Song

(74) *Attorney, Agent, or Firm* — Wang Law Firm, Inc.

(57) ABSTRACT

An external connected lamp holder has a first lamp holder, the first lamp holder is provided with a first socket matched with a lamp body, the lamp body has a first driving circuit board, the external connected lamp holder further includes a first female plug assembly. The external connected lamp holder, interconnected lamp holder, driving circuit board and lamp of the embodiments realize the installation of the lamp holder and the driving circuit board through plug-in electrical connection, instead of being welded together. This construction reduces the requirements of product precision, tooling precision and assembly precision in the automated production process, and it reduces the cost of automated manufacturing and the loss in the production process of products.

14 Claims, 10 Drawing Sheets

(56) References Cited

U.S. PATENT DOCUMENTS

| | | | | |
|---|---|---|---|---|
| 2013/0301255 | A1* | 11/2013 | Kim | F21K 9/27 362/218 |
| 2014/0126198 | A1* | 5/2014 | Dorney | F21K 9/90 362/218 |
| 2015/0176770 | A1* | 6/2015 | Wilcox | H01R 13/71 362/223 |
| 2016/0248181 | A1* | 8/2016 | Wang | H01R 13/187 |
| 2018/0019530 | A1* | 1/2018 | Fu | H01R 12/732 |
| 2018/0309252 | A1* | 10/2018 | Xu | H01R 43/20 |
| 2020/0381855 | A1* | 12/2020 | Chen | H01R 13/432 |

* cited by examiner

EXTERNAL CONNECTED LAMP HOLDER, AN INTERCONNECTED LAMP HOLDER, A DRIVING CIRCUIT BOARD AND A LAMP

RELATED APPLICATION

This application claims priority to a Chinese Patent Application No. CN 202010734752.6, filed on Jul. 28, 2020.

FIELD OF THE TECHNOLOGY

The invention relates to the technical field of lighting, in particular to an external connected lamp holder, an interconnected lamp holder, a driving circuit board and a lamp.

BACKGROUND OF THE INVENTION

In the context of energy saving and environmental protection, LED lamps are increasingly used in the home and commercial lighting fields because of their high light-emitting efficiency and good light-gathering performance.

At present, commercial lighting products are mainly assembled manually. However, with the rising labor cost in China and the difficulty of recruiting workers, many manufacturing-intensive enterprises have been plagued by the transformation and upgrading of their own production methods. Therefore, automated production will be a problem. Therefore, in order to adapt to the needs of automated production, product transformation is made to make it more convenient for automated production. Especially for customized lamps, the versatility of the connector system has always been a problem. In particular, higher requirements are put forward for the automatic connector system of lens lamps with sweeping requirements.

BRIEF SUMMARY OF THE INVENTION

In view of this, the present invention provides an external connected lamp holder, an interconnected lamp holder, a driving circuit board and a lamp to solve the above technical problems.

An external connected lamp holder includes a first lamp holder, the first lamp holder is provided with a first socket matched with a lamp body, the lamp body includes a first driving circuit board, the external connected lamp holder further includes a first female plug assembly, and the first female plug assembly includes:

a first elastic clamping piece, arranged in the first socket and being used for connecting a positive terminal;

and a second elastic clamping piece, arranged in the first socket and arranged opposite to the first elastic clamping piece to form a first clamping opening which is matched with the first driving circuit board to used for connecting a negative terminal.

advantageously, the first clamping opening is a flat channel.

advantageously, the distance between the first elastic clamping piece (301) and the second elastic clamping piece gradually decreases from the inlet to the inside and then becomes larger.

advantageously, the minimum distance between the first elastic clamping piece and the second elastic clamping piece is located in the middle and rear section of the first clamping opening.

advantageously, the first elastic clamping piece and the second elastic clamping piece are respectively provided with a first bump and a second bump at the minimum distance between each other.

An interconnected lamp holder includes a second lamp base, the second lamp base is provided with a second socket matched with the lamp body, and the lamp body comprises a first driving circuit board and a second driving circuit board, the interconnected lamp holder further comprises a second female plug assembly and a third female plug assembly, the second female plug assembly includes:

a third elastic clamping piece, arranged in the second socket;

and a fourth elastic clamping piece, arranged in the second socket and arranged opposite to the third elastic clamping piece to form a second clamping opening which is matched with the first driving circuit board;

the third female plug assembly comprises:

a fifth elastic clamping piece, arranged in the second socket and being electrically connected to one of the third elastic clamping piece and the fourth elastic clamping piece;

a sixth elastic clamping piece, arranged in the second socket and arranged opposite to the fifth elastic clamping piece to form a third clamping opening which is matched with the second driving circuit board, and being electrically connected to the other of the third elastic clamping piece and the fourth elastic clamping piece;

the entrance and exit directions of the third clamping opening and the second clamping opening are arranged parallel to each other.

advantageously, the second clamping opening and the third clamping opening are flat channels.

advantageously, the second clamping opening and the third clamping opening are arranged in a shape '八' relatively, that is, one end is far away, one end is close.

advantageously, the included angle formed by the intersection of the plane extension surface where the second clamping opening and the third clamping opening are located is 40°~70°.

A driving circuit board comprises a board body and a circuit arranged on the board body, the board body is provided with at least one plug, both sides of the plug are respectively provided with a positive conductive sheet and a negative conductive sheet, the positive conductive sheet is electrically connected to the positive terminal of the circuit, and the negative conductive sheet is connected to the negative terminal of the circuit.

advantageously, the driving circuit board is elongated, and at least one end is provided with a plug, and the plug is one end of the board body.

A lamp comprises a lamp body and an external connected lamp holder, the lamp body comprising a lamp holder and a first driving circuit board arranged on the lamp holder, the external connected lamp holder comprises a first lamp holder, and the first lamp holder is provided with a first socket that is matched with the lamp body, characterized in that, it also includes a first female plug assembly, the first female plug assembly comprises:

a first elastic clamping piece, arranged in the first socket and being used to connect the positive terminal;

and a second elastic clamping piece, arranged in the first socket and arranged opposite to the first elastic clamping piece to form a first clamping opening for connecting the negative terminal;

the first driving circuit board comprises a first board body and a first circuit arranged on the first board body, and the first board body is provided with at least one first plug which is matched with the first clamping opening, and both sides of the first plug are respectively provided with a first positive conductive sheet abutting against the first elastic clamping piece and a first negative conductive sheet abutting against the second elastic clamping piece, and the first positive conductive sheet is electrically connected to the positive terminal of the first circuit, the first negative conductive sheet is electrically connected to the negative terminal of the first circuit.

advantageously, the lamp further comprises an interconnected lamp holder, and the lamp body further comprises a second driving circuit board arranged on the lamp holder, the interconnected lamp holder comprises a second lamp base, a second female plug assembly and a third female plug assembly, the second lamp base is provided with a second socket matched with the lamp body, the second female plug assembly comprises:

a third elastic clamping piece, arranged in the second socket;

and a fourth elastic clamping piece, arranged in the second socket and arranged opposite to the third elastic clamping piece to form a second clamping opening matched with the first driving circuit board;

the third female plug assembly comprises:

a fifth elastic clamping piece, arranged in the second socket and being electrically connected to one of the third elastic clamping piece and the fourth elastic clamping piece;

and a sixth elastic clamping piece, arranged in the second socket and arranged opposite to the fifth elastic clamping piece to form a third clamping opening matched with the second driving circuit board, and being electrically connected to the other of the third elastic clamping piece and the fourth elastic clamping piece;

the entrance and exit directions of the third clamping opening and the second clamping opening are arranged parallel to each other;

the first driving circuit board is provided with at least two first plugs, one of the first plugs is matched with the second clamping opening, and the second driving circuit board comprises a second board body and a second circuit arranged on the second board body, and the second board body has at least one second plug which is matched with the third clamping opening, both sides of the second plug is respectively provided with a second positive conductive sheet abutting against the fifth elastic clamping piece and a second negative conductive sheet abutting against the sixth elastic clamping piece, the second positive conductive sheet is electrically connected to the positive terminal of the second circuit, and the second negative conductive sheet is electrically connected to the negative terminal of the second circuit.

advantageously, the lamp body is in the shape of a bar, and the external connected lamp holder and the interconnected lamp holder are respectively arranged at both ends of the lamp body, the insertion direction of the first clamping opening, the second clamping opening and the third clamping opening is arranged in parallel with the length direction of the lamp body.

advantageously, the first driving circuit board and the second driving circuit board are relatively arranged in a shape '八', that is, one end is far away, one end is close.

advantageously, the included angle formed by the intersection of the extended plane of the first driving circuit board and the second driving circuit board is 40°-70°.

advantageously, the lamp holder is provided with a lamp cavity (204) penetrating in the length direction and closed in radial direction.

advantageously, the external connected lamp holder and the interconnected lamp holder respectively encapsulate two ends of the lamp cavity.

advantageously, the lamp cavity is provided with a first slot and a second slots which are arranged oppositely and provided for fixing the first driving circuit board.

advantageously, the lamp body further comprises a second driving circuit board, and the lamp cavity is provided with a third card slot and a fourth card slot which are arranged oppositely and used for fixing the second driving circuit board.

The invention does not need welding to realize electrical connection, and is suitable for automated assembly production operations; it has good versatility, covers the rotation angle of the driving circuit board from 40° to 70°, and elastic clamping pieces has a bell mouth design, and is perfectly compatible with most sweep light lamps. Direct use of the drive circuit board and contact spring conduction, without female socket or patch socket, it effectively reduce the cost, and effectively solve the unsteady size of the parts of the lamp on the automatic assembly of the impact of the problem.

Technical Effects of the Present Invention

The external connected lamp holder, interconnected lamp holder, driving circuit board and lamp of the embodiments realize the installation of the lamp holder and the driving circuit board through plug-in electrical connection, instead of the original welding to realize the electric connection. It is easier to realize automation. The positive and negative conductive sheets are respectively electrically arranged on the oppositely arranged elastic clamping pieces, matched with the driving circuit boards that arrange the conductive sheets on both sides of the plug, and it can provide enough space for the driving circuit board to plug and match in a limited space, and it reduces the requirements of product precision, tooling precision and assembly precision in the automated production process, and it reduces the cost of automated manufacturing and the loss in the production process of products.

BRIEF DESCRIPTION OF THE DRAWINGS

The embodiments of the present invention are described below in conjunction with the drawings, in which.

DETAILED DESCRIPTION OF THE INVENTION

Specific embodiments of the present invention will be described in further detail below based on the drawings. It should be understood that the description of the embodiments of the present invention herein is not intended to limit the protection scope of the present invention.

Figure 1:
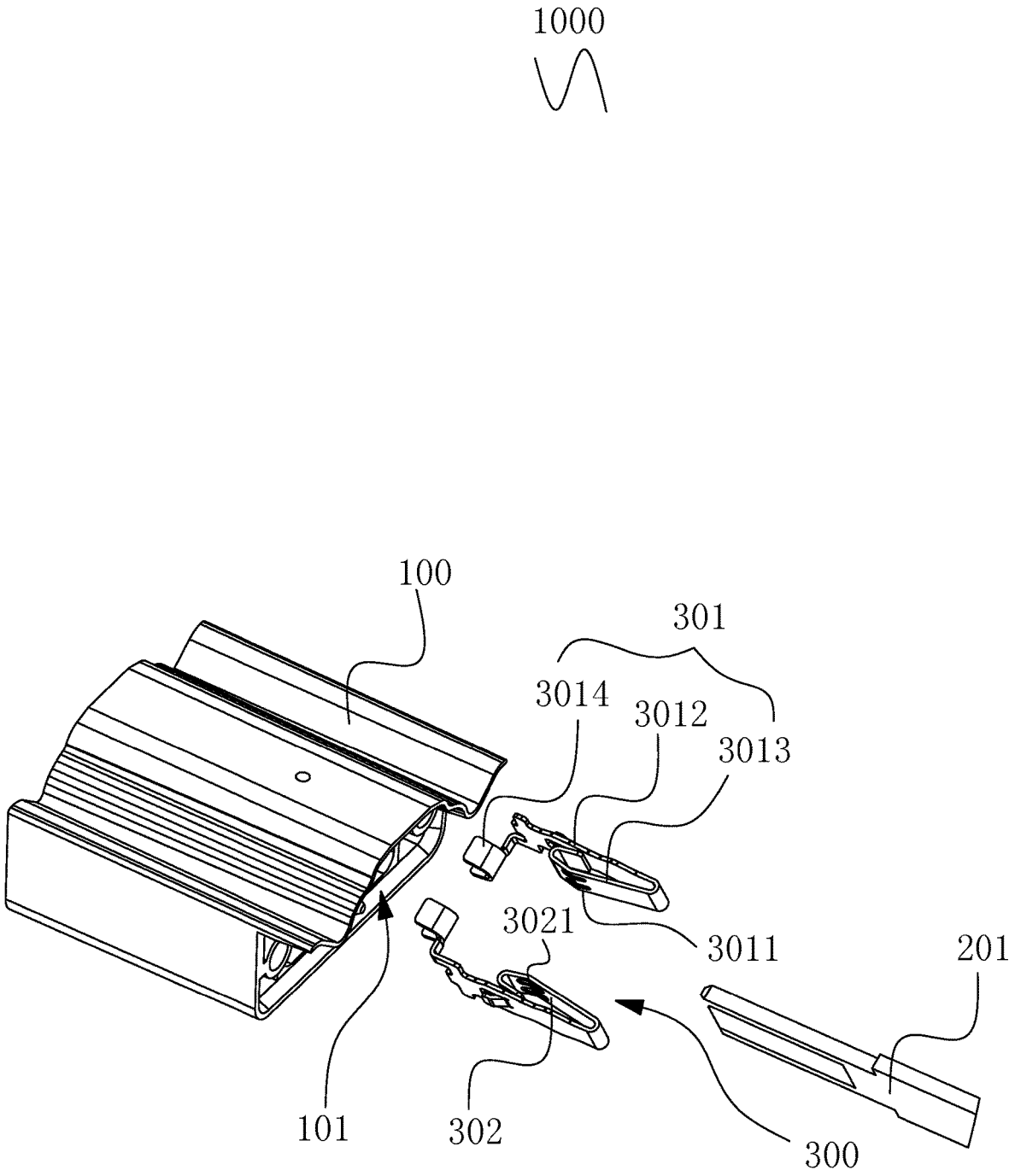
FIG. 1 is an explosive structure schematic diagram of the external connected lamp holder of this embodiment.
Figure 2:
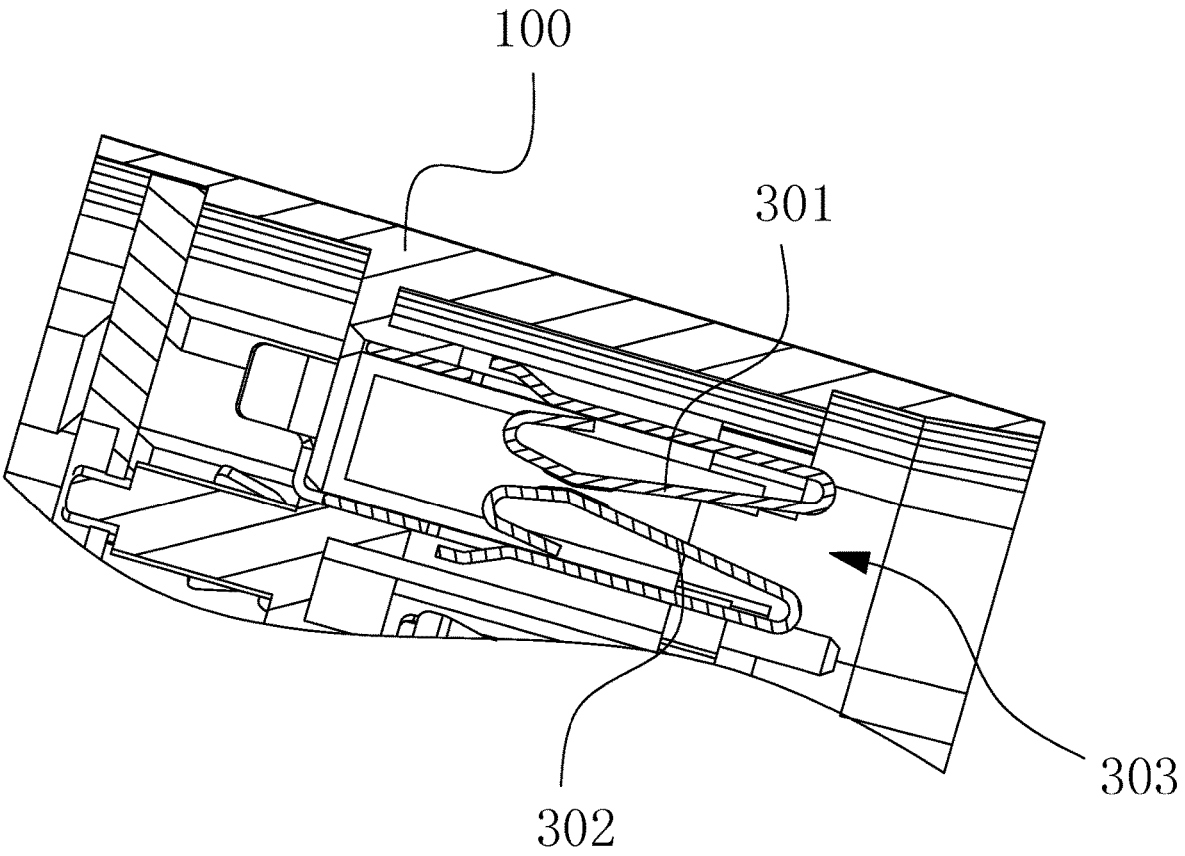
FIG. 2 is a schematic cross-sectional view (a cross-sectional view along the insertion direction of the first clamping opening 303) of the partial structure of the external connected lamp holder of this embodiment.
Figure 3:
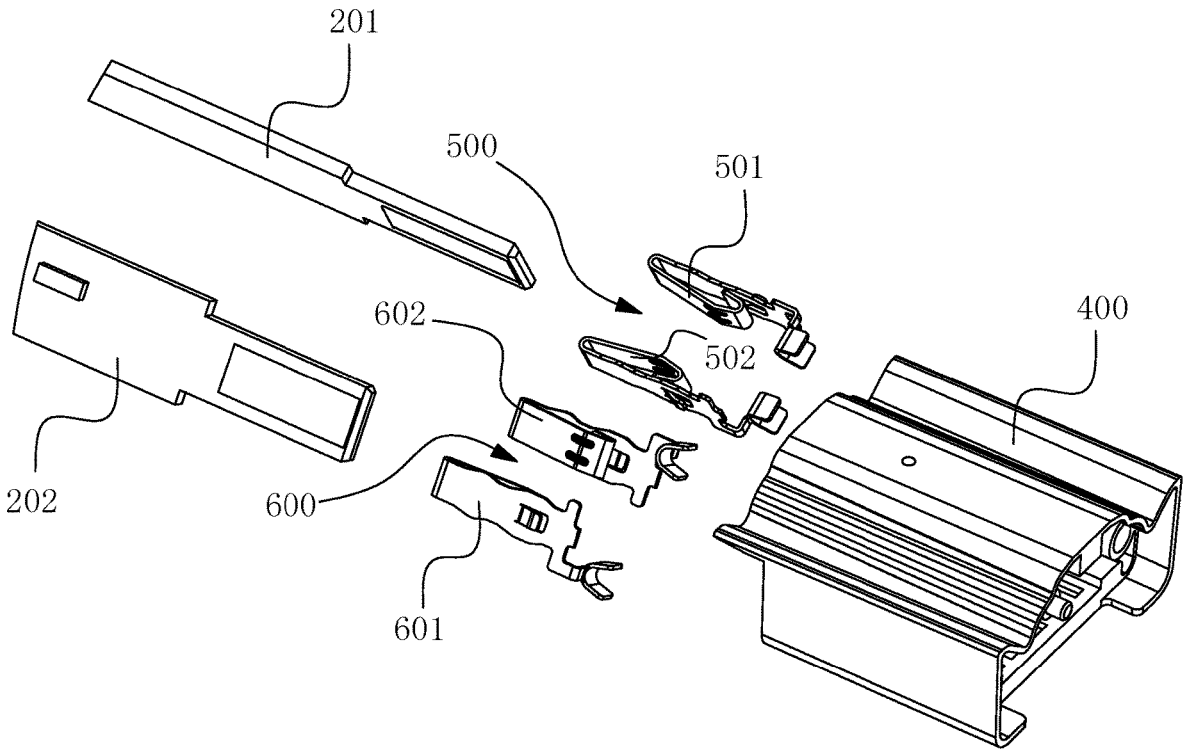
FIG. 3 is an explosive structure schematic diagram of the interconnected lamp holder of this embodiment.
Figure 4:
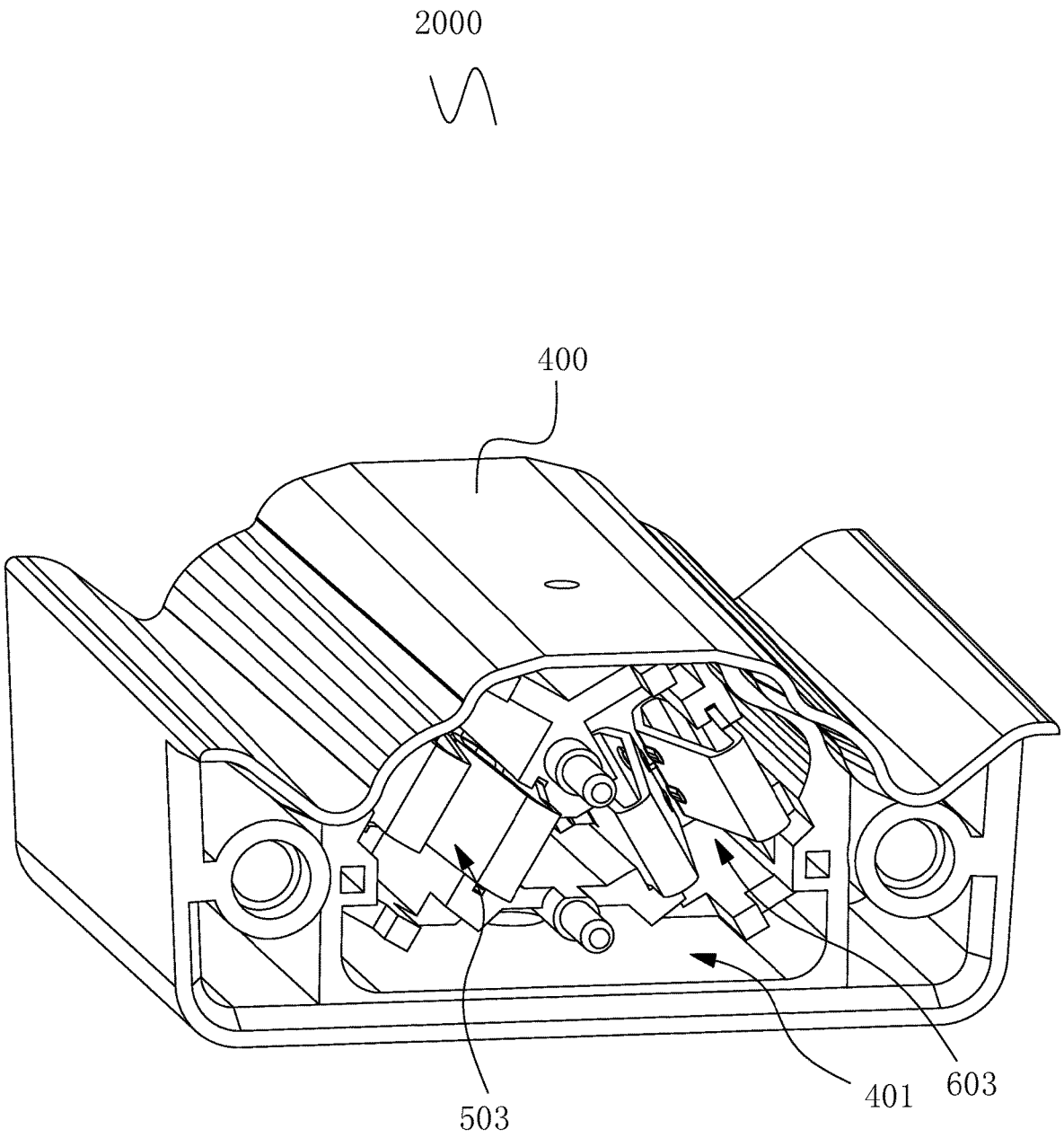
FIG. 4 is a schematic diagram of the three-dimensional structure of the interconnected lamp holder of this embodiment.
Figure 5:
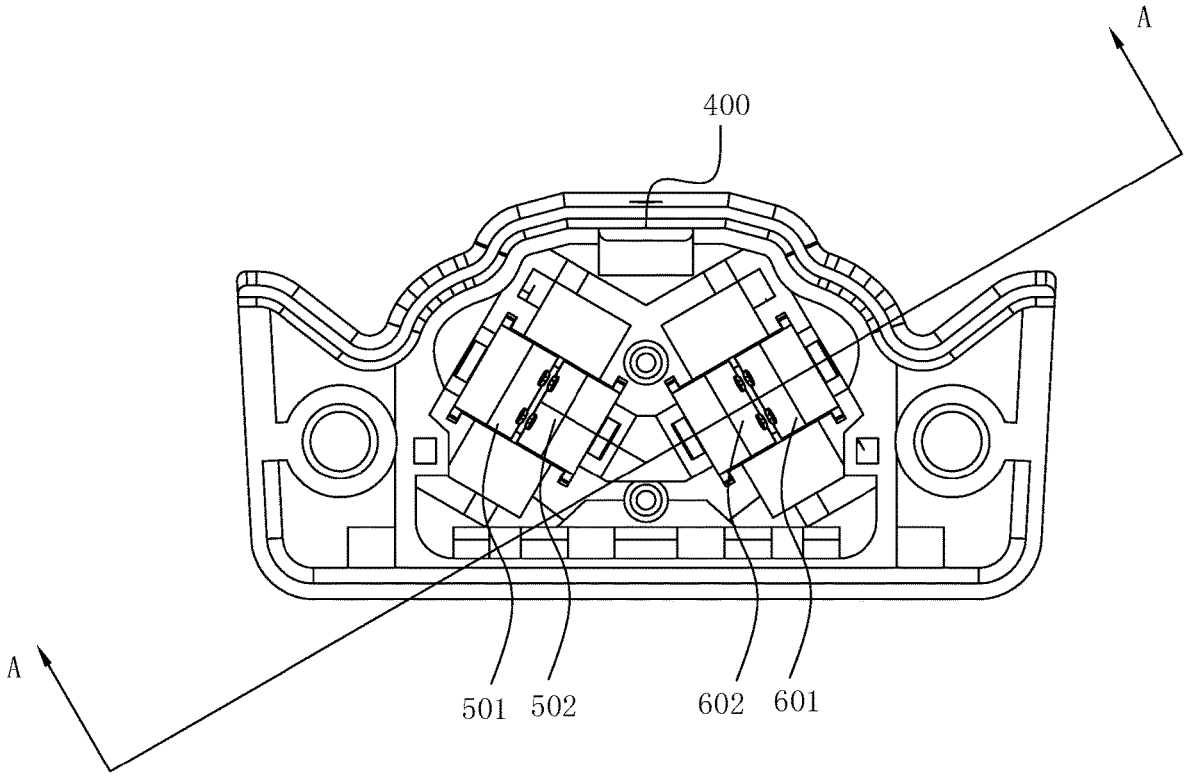
FIG. 5 is a structure schematic diagram of the interconnected lamp holder of this embodiment.
Figure 6:
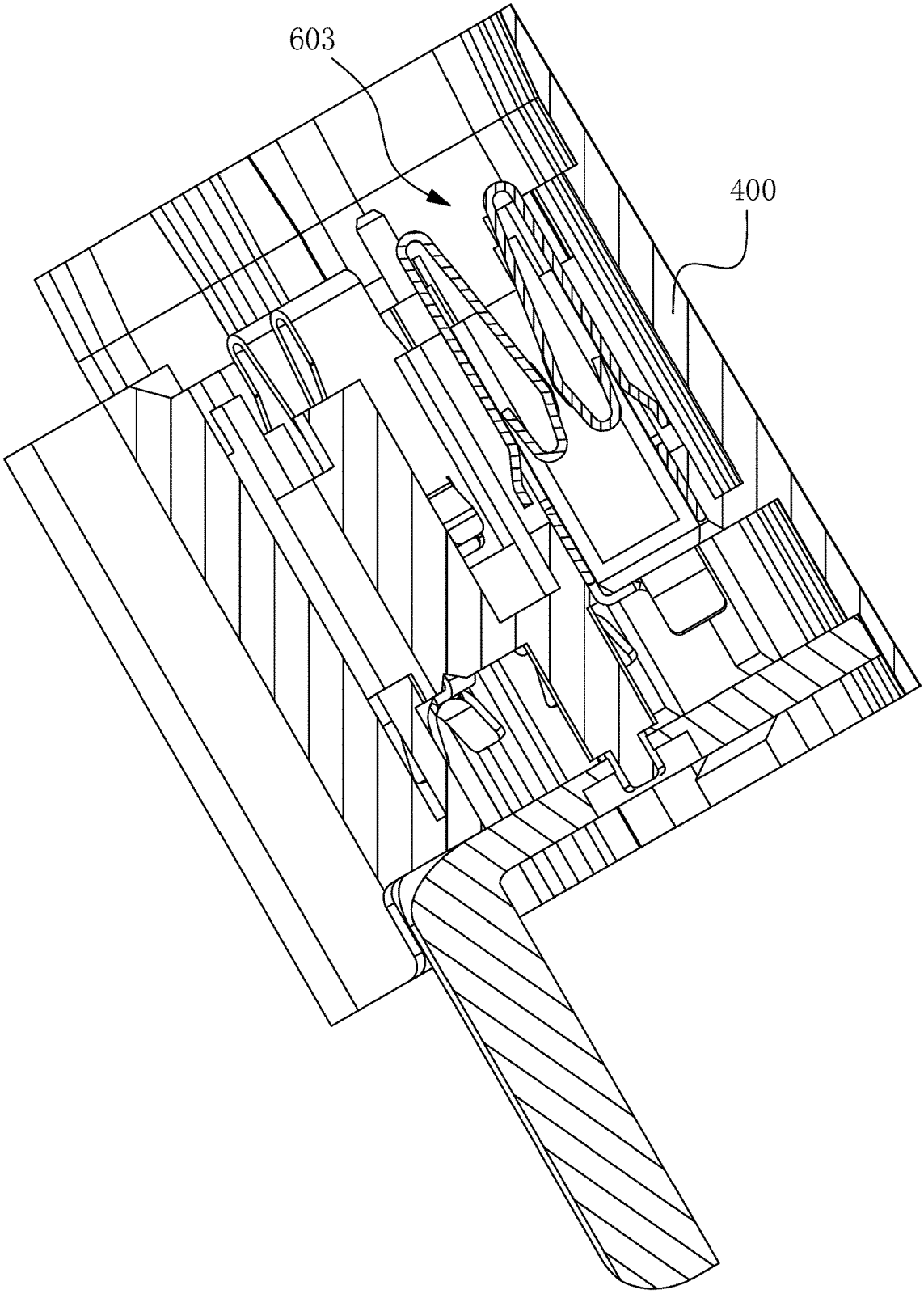
FIG. 6 is a schematic cross-sectional view for FIG. 5 in the A-A direction.

As shown in FIGS. 1 and 2, an external connected lamp holder 1000 in this embodiment includes a first lamp holder 100, and the first lamp holder 100 is provided with a first socket 101 that is plugged and matched with a lamp body. The connection between the lamp body and the external connected lamp holder 1000 has two functions. One is to realize the electrical connection between the driving circuit board in the lamp body and the external connected lamp holder 1000, and the other is to facilitate to realize the encapsulation of the connection port between the two. The lamp body includes a first driving circuit board 201.

In order to realize the electrical connection between the first driving circuit board 201 and the external connected lamp holder 1000, the external connected lamp holder 1000 further includes a first female plug assembly 300, and the first female plug assembly 300 includes a first elastic clamping piece 301 and a second elastic clamping piece 302. The first elastic clamping piece 301 is arranged in the first socket 101 for connecting the positive terminal; the second elastic clamping piece 302 is arranged in the first socket 101 for connecting the negative terminal and is arranged opposite to the first elastic clamping piece 301 to form a first clamping opening 303 which is mated with the first driving circuit board 201.

Since the first clamping opening 303 is formed by the relative arrangement of the first elastic clamping piece 301 and the second elastic clamping piece 302, the size of the first clamping opening 303 can be changed through deformation and a clamping force can be generated.

In this embodiment, the positive and negative terminals of the external connected lamp holder 1000 are respectively arranged on the first elastic clamping piece 301 and the second elastic clamping piece 302, which are arranged oppositely, thus, under the condition that the volume of the lamp holder remains unchanged, the area of the elastic clamping piece can be set on one side is increased. Correspondingly, the area of the male plug matched with the first female plug assembly 300 is increased, thereby reducing the requirements for product accuracy, tooling accuracy and assembly accuracy in the automated production process, and reducing the automated manufacturing cost.

In order to further increase the contact area provided by the elastic clamping piece to the mating male plug, in this embodiment, the first clamping opening 303 is a flat channel. The flat channel can be matched with the flat male plug and has a longer electrical contact area.

In order to adapt to the driving circuit boards with different mounting angles, the distance between the first elastic clamping piece 301 and the second elastic clamping piece 302 gradually decreases from the inlet to the inside and then becomes larger. The above arrangement can make the first clamping opening 303 form a bell mouth structure, and the assembly can be realized even when the fitting angle of the mating male plug is slightly changed.

In order to increase the size of the entrance of the bell mouth, in this embodiment, the minimum distance between the first elastic clamping piece 301 and the second elastic clamping piece 302 is located in the middle and rear section of the first clamping opening 303.

In order to maintain effective electrical contact for the plug-in electrical connection, in this embodiment, the first elastic clamping piece 301 and the second elastic clamping piece 302 are respectively provided with a first bump 3011 and a second bump 3021 at the minimum distance between each other. The first bumps 3011 are provided with two which are spaced apart to ensure the effectiveness of the contact electrical connection. The same, the second bumps 3021 are provided with two which are spaced apart.

The specific structures of the first elastic clamping piece 301 and the second elastic clamping piece 302 are similar or the same. In this embodiment, the structures are the same and arranged symmetrically. The first elastic clamping piece 301 includes a fixing part 3012 and an elastic part 3013, and the tail of the fixing part 3012 is provided with a welding part 3014 for welding the terminal. The elastic part 3013 is formed by folding the front end of the fixing part 3012 backwards, and the end of the elastic part 3013 is folded toward the fixing part 3012.

As shown in FIG. 3 to FIG. 6, the interconnected lamp holder 2000 of this embodiment includes a second lamp base 400, the second lamp base 400 is provided with a second socket 401 mated with the lamp body 200, and the lamp body 200 includes a first driving circuit board 201 and a second driving circuit board 202, the interconnected lamp holder 2000 further includes a second female plug assembly 500 and a third female plug assembly 600.

The interconnected lamp holder 2000 is used to connect the circuit conduction between two driving circuit boards. The second female plug assembly 500 and the third female plug assembly 600 are respectively connected to a male plug of a driving circuit board. In this embodiment, the second female plug assembly 500 includes a third elastic clamping piece 501 and a fourth elastic clamping piece 502, the third elastic clamping piece 501 is arranged in the second socket 401; the fourth elastic clamping piece 502 is arranged in the second socket 401 and arranged opposite to the third elastic clamping piece 501 to form a second clamping opening 503 that is plug-in-fitted with the first driving circuit board 201. The third female plug assembly 600 includes a fifth elastic clamping piece 601 and a sixth elastic clamping piece 602. The fifth elastic clamping piece 601 is disposed in the second socket 401 and is electrically connected to one of the third elastic clamping piece 501 and the four elastic clamping pieces 502; the sixth elastic clamping piece 602 is disposed in the second socket 401 and is arranged opposite to the fifth elastic clamping piece 601 to form a third clamping opening 603 that is plug-in-fitted with the second driving circuit board 202, and the sixth elastic clamping piece 602 are electrically connected to the other of the third elastic clamping piece 501 and the fourth elastic clamping piece 502. Thus, the electrical connection is realized after the male plugs of the two driving circuit boards are inserted into the second clamping opening 503 and the third clamping opening 603 respectively.

Since the third elastic clamping piece 501 and the fourth elastic clamping piece 502 in the interconnected lamp holder 2000 of this embodiment are arranged oppositely, the fifth elastic clamping piece 601 and the sixth elastic clamping piece 602 are arranged oppositely, thus, under the condition that the volume of the lamp cap remains unchanged, the area of the elastic clamping piece can be set on one side is increased. Correspondingly, the area of the male plugs that matches the second female plug assembly 500 and the third female plug assembly 600 is increased, compared to pin-shaped plugs, it can reduce the requirements of product accuracy, tooling accuracy and assembly accuracy in the automatic production process, and reduce the cost of automatic manufacturing.

The specific structures of the second clamping opening 503 of the second female plug assembly 500 and the third clamping opening 603 of the third female plug assembly 600 are similar to or the same as the first clamping opening 303. Specifically, the second clamping opening 503 and the third clamping opening 603 are flat channels. The distance between the third elastic clamping piece 501 and the fourth elastic clamping piece 502 gradually decreases inward from the inlet and then becomes larger. The distance between the fifth elastic clamping piece 601 and the sixth elastic clamping piece 602 gradually decreases inward from the inlet and then becomes larger. The minimum distance between the third elastic clamping piece 501 and the fourth elastic clamping piece 502 is located in the middle and rear section of the second clamping opening 503. The minimum distance between the fifth elastic clamping piece 601 and the sixth elastic clamping piece 602 is located in the middle and rear section of the third clamping piece opening 603. Therefore, the contact area provided by the elastic clamping piece for the mating male plug can be further increased, the driving circuit board of different installation angles can be adapted, and the plug-in electrical connection between the male plug and the female plug assembly can maintain effective electrical contact.

In order to reduce the automated operation steps, in this embodiment, the in and out directions of the third clamping opening 603 and the second clamping opening 503 are arranged parallel to each other. In this way, as long as the male plug of the driving circuit board is arranged in parallel and the position and angle are adjusted, the assembly can be completed after being aligned and inserted with the interconnected lamp holder 2000 once.

In order to correspond to the arrangement form of the double-row driving circuit board of the scanning lamp, in this embodiment, the second clamping opening 503 and the third clamping opening 603 are arranged in a shape '八', that is, one end is far away, one end is close. Further, the included angle formed by the intersection of the plane extension surface where the second clamping opening 503 and the third clamping opening 603 are located is 40°-70°.

Figure 7:
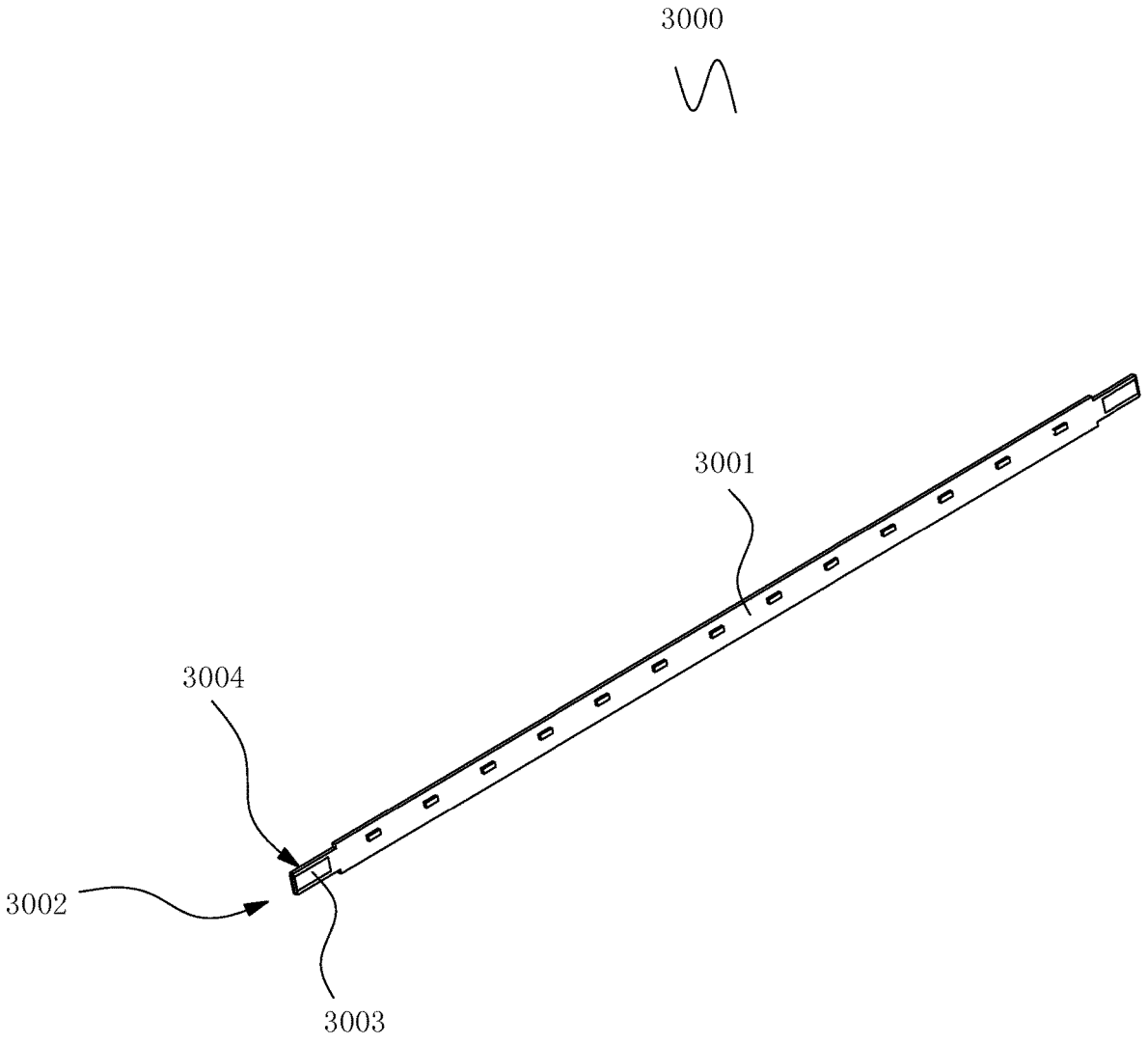
FIG. 7 is a schematic diagram of the three-dimensional structure of the driving circuit board of this embodiment.

As shown in FIG. 7, the driving circuit board 3000 of this embodiment includes a board body 3001 and a circuit provided on the board body 3001 (not shown in the figure, embedded in the board body 3001), and the board body 3001 has at least one plug 3002. A positive conductive sheet 3003 and a negative conductive sheet 3004 are respectively provided on both sides of the plug 3002. The positive conductive sheet 3003 is electrically connected to the positive terminal of the circuit, and the negative conductive sheet 3004 is connected to the negative terminal of the circuit.

Depending on the shape of the lamp, the shape of the driving circuit board is also diverse, generally circular, square or elongated. In this embodiment, the elongated shape is taken as an example for description. The driving circuit board 3000 is elongated, at least one end is provided with the plug 3002, and the plug 3002 is the end of the board body 3001. The end of the board body 3002 itself is set as a plug, which can reduce the manufacturing and installation of plug-in parts and simplify the structure.

The above-mentioned external connected lamp holder 1000 can be used for lamps with a single-row driver circuit board or a double-row driver circuit board to electrically connect the external power supply with the driving circuit board, while the interconnected lamp holder 2000 is used for lamps with a double-row driving circuit board to electrically connect the two driving circuit boards.

Figure 8:
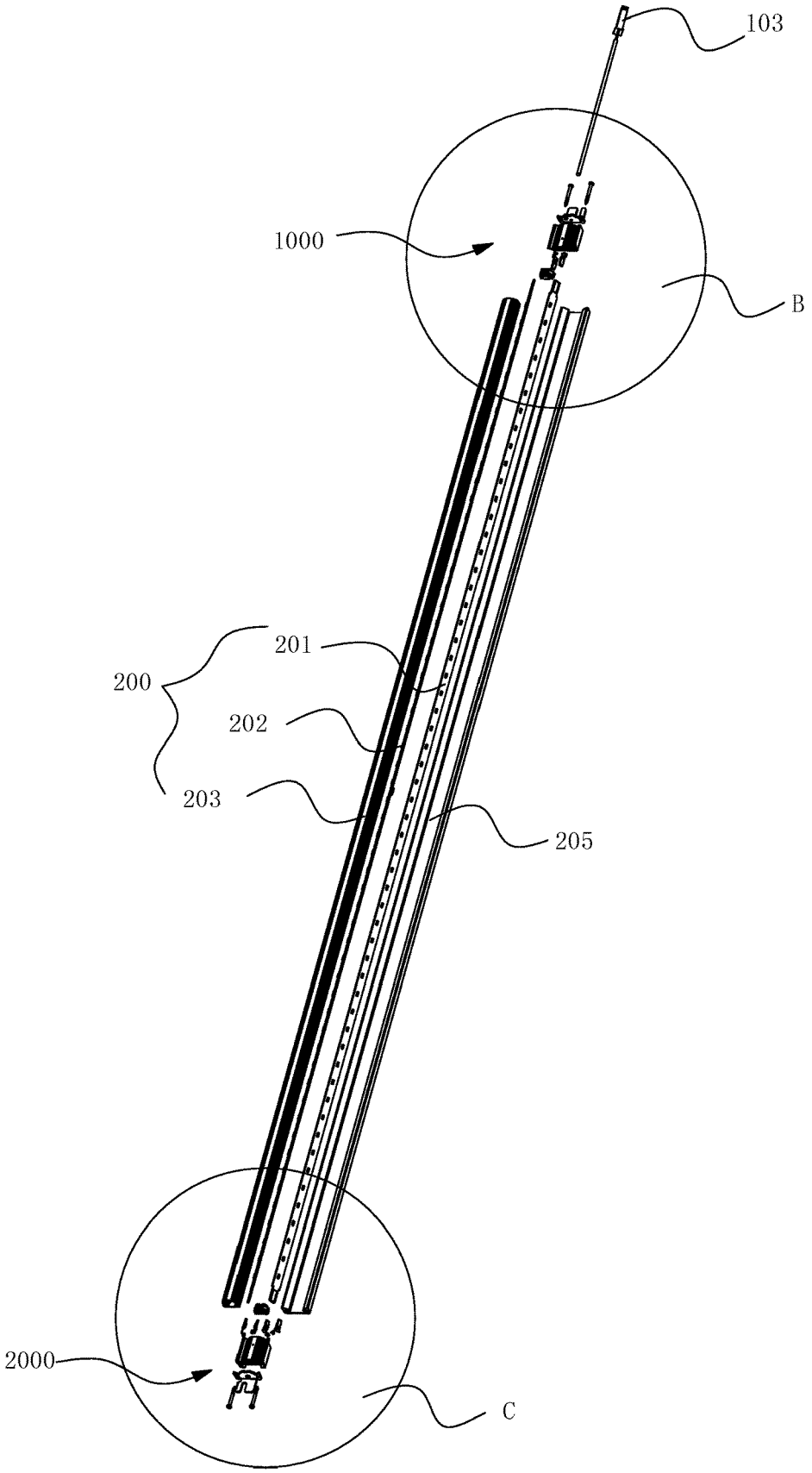
FIG. 8 is an explosive structure schematic diagram of the lamp in this embodiment.
Figure 9:
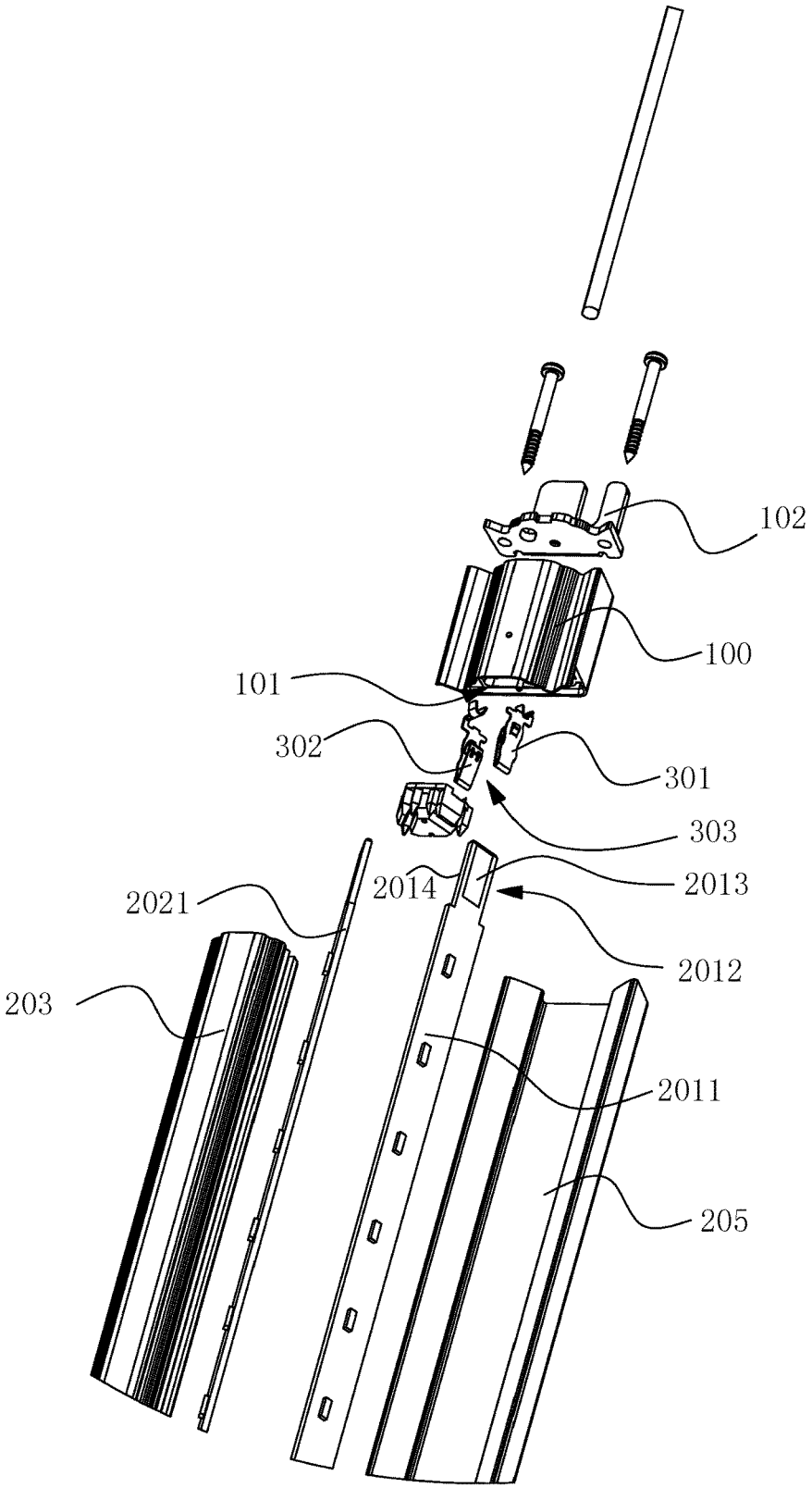
FIG. 9 is an enlarged schematic diagram of part B marked in the FIG. 8.
Figure 10:
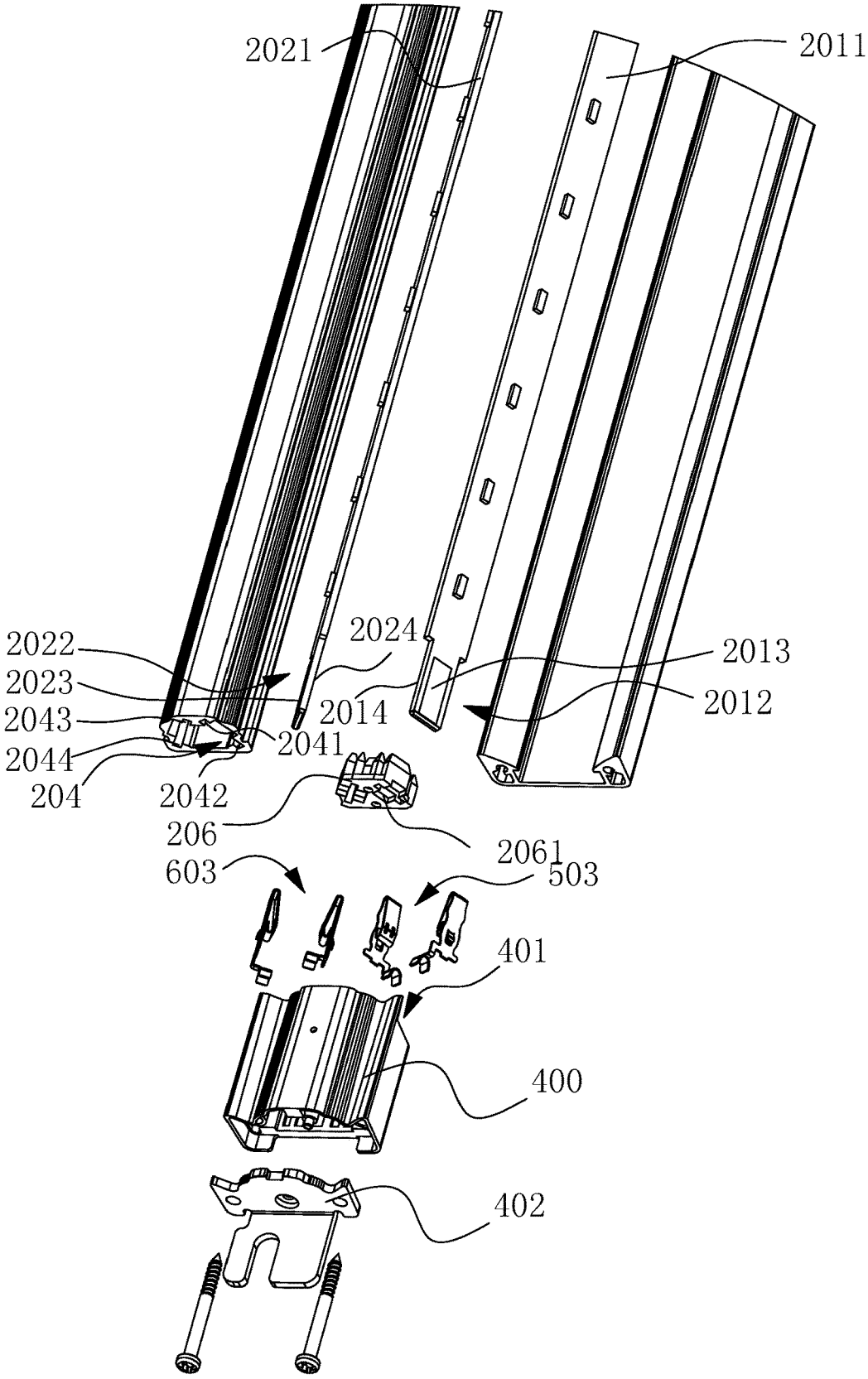
FIG. 10 is enlarged schematic diagram of part C marked in the FIG. 8.

As shown in FIG. 8 to FIG. 10, the lamp of this embodiment takes a scanning lamp with a double-row driving circuit board as an example. The lamp includes a lamp body 200, an external connected lamp holder 1000, and an interconnected lamp holder 2000. The lamp body 200 includes a lamp holder 203 and a first driving circuit board 201 and a second driving circuit board 202 arranged on the lamp holder 203, the external connected lamp holder 1000 includes a first lamp holder 100, a first fixing plate 102 and an external plug 103, the external plug 103 is provided with a positive terminal which is connected with the first elastic clamping piece of 301 and a negative terminal which is connected with the second elastic clamping piece 302.

The first lamp holder 100 is provided with a first socket 101 and a first female plug assembly 300 mated with the lamp body 200. The interconnected lamp holder 2000 includes a second lamp base 400, a second fixing plate 402, and a second female plug assembly 500 and a third female plug assembly 600, the second lamp base 400 is provided with a second socket 401 mated with the lamp body 200.

The first driving circuit board 201 includes a first board body 2011 and a first circuit arranged on the first board body 2011. The first board body 2011 is provided with two first plugs 2012, one of which is plug-in-fitted connected to the first clamping opening 303, and the other first plug 2012 is plug-in-fitted connected to the second clamping opening 503. Both sides of the first plug 2012 are respectively the first positive conductive sheet 2013 and the first negative conductive sheet 2014. The first positive conductive sheet 2013 is electrically connected to the positive terminal of the first circuit, and the first negative conductive sheet 2014 is electrically connected to the negative terminal of the first circuit. The second driving circuit board 202 includes a second board body 2021 and a second circuit provided on the second board body 2021. The second board body 2021 has a second plug 2022 plug-in fit with the third clamping port 603, both sides of the second plug 2021 is respectively provided with a second positive conductive sheet 2023 abutting against the fifth elastic clamping piece 601 and a negative conductive sheet 2024 abutting against the sixth elastic clamping piece 602, the second positive conductive sheet 2023 is electrically connected to the positive terminal of the second circuit, and the second negative conductive sheet 2024 is electrically connected to the negative terminal of the second circuit. After the assembly is completed, the first driving circuit board 201 and the second driving circuit board 202 are electrically connected in the interconnected lamp holder 2000, and the first driving circuit board 201 is also electrically connected with the external connected lamp holder 1000 to realize the external power supply to supply power to the lamp as a whole.

The lamp body 200 of this embodiment is in the shape of a bar, the external connected lamp holder 1000 and the interconnected lamp holder 2000 are respectively arranged at both ends of the lamp body 200, the insertion direction of the first clamping opening 303, the second clamping opening 503 and the third clamping opening 603 is parallel to the length direction of the lamp body 200.

The lamp in this embodiment is a sweeping lamp with a larger irradiation area, and the first driving circuit board 201 and the second driving circuit board 202 are arranged in a shape '八', that is, one end is far away, one end is close. The LED chips are arranged on the outside of the first driving circuit board 201 and the second driving circuit board 202 to emit light.

In this embodiment, the included angle formed by the intersection of the extended planes of the first driving circuit board 201 and the second driving circuit board 202 is 60°, and the setting of the angle is related to the scanning needs and can be adjusted.

Sweep lights are frequently used in display cabinets, especially in freezers, which require waterproof treatment. For this reason, the lamp holder 203 of this embodiment is provided with a lamp cavity 204 which is penetrated in the length direction and closed in radial direction and can be manufactured by extrusion molding. The lamp holder 203 also includes a lamp base 205, and both sides of the lamp base 205 are provided with shading plates to prevent glare. The external connected lamp holder 1000 and the interconnected lamp holder 2000 respectively encapsulate the two ends of the lamp cavity 204. In order to improve the waterproof effect, the two ends of the lamp cavity 204 are also provided with sealing plugs 206, and the sealing plugs 206 are provided with via holes 2061, which are used for the plugs of each driving circuit board to pass through.

In order to facilitate fixing and installation, ranged oppositely and provided for fixing the first driving circuit board 201. The lamp body 200 further includes a second driving circuit board 202. The lamp cavity 204 is provided with a third card slot 2043 and a fourth card slot 2044 arranged oppositely for fixing the second driving circuit board 202.

The above are only preferred embodiments of the present invention and are not used to limit the protection scope of the present invention. Any modification, equivalent replacement or improvement within the spirit of the present invention, etc. is all covered by the scope of the claims of the present invention.

What is claimed is:

1. A lamp, comprising a lamp body (200), an external connected lamp holder (1000), and an interconnected lamp holder (2000), the lamp body (200) comprising a lamp holder (203), a first driving circuit board (201) and a second driving circuit board (202) both arranged on the lamp holder (203), the external connected lamp holder (1000) comprises a first lamp holder (100), and the first lamp holder (100) is provided with a first socket (101) that is matched with the lamp body (200), characterized in that, the external connected lamp holder (1000) also includes a first female plug assembly (300), the first female plug assembly (300) comprises:

a first elastic clamping piece (301), arranged in the first socket (101) and being used to connect a positive terminal;

and a second elastic clamping piece (302), arranged in the first socket (101) and arranged opposite to the first elastic clamping piece (301) to form a first clamping opening (303) for connecting a negative terminal;

the interconnected lamp holder (2000) comprises a second lamp base (400), a second female plug assembly (500) and a third female plug assembly (600), the second lamp base (400) is provided with a second socket (401) matched with the lamp body (200), the second female plug assembly (500) comprises:

a third elastic clamping piece (501), arranged in the second socket (401); and a fourth elastic clamping piece (502), arranged in the second socket (401) and arranged opposite to the third elastic clamping piece (501) to form a second clamping opening (503) matched with the first driving circuit board (201);

the third female plug assembly (600) comprises:

a fifth elastic clamping piece (601), arranged in the second socket (401) and being electrically connected to one of the third elastic clamping piece (501) and the fourth elastic clamping piece (502); and a sixth elastic clamping piece (602), arranged in the second socket (401) and arranged opposite to the fifth elastic clamping piece (601) to form a third clamping opening (603) matched with the second driving circuit board (202), and being electrically connected to the other of the third elastic clamping piece (501) and the fourth elastic clamping piece (502);

the entrance and exit directions of the third clamping opening (603) and the second clamping opening (503) are arranged parallel to each other;

the first driving circuit board (201) comprises a first board body (2011) and a first circuit arranged on the first board body (2011), and the first board body (2011) is provided with at least two first plugs (2012), one of the two first plugs (2012) is matched with the first clamping opening (303), and both sides of the aforementioned first plug (2012) are respectively provided with a first positive conductive sheet (2013) abutting against the first elastic clamping piece (301) and a first negative conductive sheet (2014) abutting against the second elastic clamping piece (302), and the first positive conductive sheet (2013) is electrically connected to the positive terminal of the first circuit, the first negative conductive sheet (2014) is electrically connected to the negative terminal of the first circuit one of the first plugs (2012) is matched with the second clamping opening (503), and the second driving circuit board (202) comprises a second board body (2021) and a second circuit (2015) arranged on the second board body (2021), and the second board body (2021) has at least one second plug (2022) which is matched with the third clamping opening (603), both sides of the second plug (2021) are respectively provided with a second positive conductive sheet (2023) abutting against the fifth elastic clamping piece (601) and a second negative conductive sheet (2024) abutting against the sixth elastic clamping piece (602), the second positive conductive sheet (2023) is electrically connected to the positive terminal of the second circuit (2025), and the second negative conductive sheet (2024) is electrically connected to the negative terminal of the second circuit (2025).

2. The lamp as claimed in claim 1, wherein the first clamping opening (303), second clamping opening (503) and third clamping opening (603) are flat channels.

3. The lamp as claimed in claim 2, wherein the second clamping opening (503) and the third clamping opening (603) are tilted relative to each other.

4. The lamp as claimed in claim 3, where the second clamping opening (503) and the third clamping opening (603) are tilted from 40° to 70° relative to each other.

5. The lamp as claimed in claim 1, wherein the lamp holder (203) is provided with a lamp cavity (204) penetrating in a lengthwise direction and closed in a radial direction.

6. The lamp as claimed in claim 5, wherein the external connected lamp holder (1000) and the interconnected lamp holder (2000) respectively encapsulate two ends of the lamp cavity (204).

7. The lamp as claimed in claim 5, wherein the lamp holder (203) is provided with a first slot (2041) and a second slot (2042) which are arranged oppositely facing the lamp cavity (204) and provided for fixing the first driving circuit board (201) in the lamp holder (203).

8. The lamp as claimed in claim 5, wherein the lamp holder (203) is provided with a third card slot (2043) and a fourth card slot (2044) which are arranged oppositely facing the lamp cavity (204) and used for fixing the second driving circuit board (202) in the lamp holder (203).

9. The lamp as claimed in claim 1, wherein a distance between the first elastic clamping piece (301) and the second elastic clamping piece (302) gradually decreases from the inlet to the inside and then becomes larger.

10. The lamp as claimed in claim 9, wherein the minimum distance between the first elastic clamping piece (301) and the second elastic clamping piece (302) is located in the middle and rear section of the first clamping opening (303).

11. The lamp as claimed in claim 9, wherein the first elastic clamping piece (301) and the second elastic clamping piece (302) are respectively provided with a first bump (3011) and a second bump (3021) separated from and opposite of each other.

12. The lamp as claimed in claim 1, wherein the first driving circuit board (201) and the second driving circuit board (202) are tilted relative to each other.

13. The lamp as claimed in claim 12, wherein the included angle formed by the intersection of the extended plane of the first driving circuit board (201) and the second driving circuit board (202) is 40°-70°.

14. The lamp as claimed in claim 1, wherein the lamp body (200) is in the shape of a bar, and the external connected lamp holder (1000) and the interconnected lamp holder (2000) are respectively arranged at both ends of the lamp body (200), the insertion direction of the first clamping opening (303), the second clamping opening (503) and the third clamping opening (603) is arranged in parallel with the length direction of the lamp body (200).

* * * * *